US010294708B2

(12) United States Patent
Quaiser et al.

(10) Patent No.: US 10,294,708 B2
(45) Date of Patent: May 21, 2019

(54) SERVICING AND MONITORING SYSTEM FOR MONITORING A DOOR MEMBER

(71) Applicant: FRABA B.V., SG Heerlen (NL)

(72) Inventors: Andre Quaiser, Bonn (DE); Christian Leeser, Duesseldorf (DE)

(73) Assignee: FRABA B.V., SG Heerlen (NL)

( * ) Notice: Subject to any disclaimer, the term of this patent is extended or adjusted under 35 U.S.C. 154(b) by 0 days.

(21) Appl. No.: 15/738,127

(22) PCT Filed: Apr. 28, 2016

(86) PCT No.: PCT/EP2016/059511
§ 371 (c)(1),
(2) Date: Dec. 20, 2017

(87) PCT Pub. No.: WO2017/005388
PCT Pub. Date: Jan. 12, 2017

(65) Prior Publication Data

US 2018/0179800 A1 Jun. 28, 2018

(30) Foreign Application Priority Data

Jul. 8, 2015 (DE) ..... 10 2015 111 072

(51) Int. Cl.

| | |
|---|---|
| ***E05F 11/00*** | (2006.01) |
| ***E05F 15/40*** | (2015.01) |
| ***E05F 15/668*** | (2015.01) |
| ***E06B 9/68*** | (2006.01) |
| ***G08B 21/18*** | (2006.01) |

(52) U.S. Cl.
CPC ..... *E05F 15/40* (2015.01); *E05F 15/668* (2015.01); *E06B 9/68* (2013.01); *G08B 21/18* (2013.01); *E05Y 2400/40* (2013.01); *E05Y 2400/44* (2013.01); *E05Y 2400/45* (2013.01); *E05Y 2400/458* (2013.01); *E05Y 2900/106* (2013.01); *E06B 2009/6818* (2013.01)

(58) Field of Classification Search
CPC ..... E05F 15/40; E05F 15/668; G08B 21/02; E06B 9/68; E06B 2009/6818; E05Y 2900/106; E05Y 2400/458; E05Y 2400/40
USPC ..... 49/197, 199
See application file for complete search history.

(56) References Cited

U.S. PATENT DOCUMENTS

| | | | | |
|---|---|---|---|---|
| 5,872,513 A * | 2/1999 | Fitzgibbon | ..... | E05B 43/005 235/382 |
| 6,310,548 B1 * | 10/2001 | Stephens, Jr. | ..... | G08B 13/08 340/540 |
| 7,708,048 B2 * | 5/2010 | Mays | ..... | G07C 9/00309 160/1 |

(Continued)

*Primary Examiner* — Jerry E Redman
(74) *Attorney, Agent, or Firm* — Norman B. Thot

(57) ABSTRACT

A servicing and monitoring system for monitoring a gate member which is moved by a drive apparatus. The servicing and monitoring system includes a drive control unit which actuates the drive apparatus, a detection device which detects a gate status of the gate member, a first data connection which connects the drive control unit and the detection device and via which a status signal of the gate member is transmitted from the detection device to the drive control unit, and a data reading device which reads the status signal sent from the detection device to the drive control unit and which outputs an alarm signal depending on the status signal read by the data reading device.

14 Claims, 1 Drawing Sheet

(56) References Cited

U.S. PATENT DOCUMENTS

| | | | | |
|---|---|---|---|---|
| 8,836,469 | B2 * | 9/2014 | Fitzgibbon | H04B 1/713 340/5.1 |
| 9,122,254 | B2 * | 9/2015 | Cate | E05F 15/60 |
| 9,587,420 | B2 * | 3/2017 | Keller, Jr. | E05F 15/40 |
| 9,793,836 | B2 * | 10/2017 | Bouchez | H02M 7/003 |
| 2004/0085185 | A1 * | 5/2004 | Waggamon | G07C 9/00309 340/5.7 |
| 2005/0012631 | A1 | 1/2005 | Gregori et al. | |
| 2006/0103503 | A1 * | 5/2006 | Rodriguez | G05B 19/0428 340/5.71 |
| 2010/0107498 | A1 * | 5/2010 | Ley | E05F 15/668 49/199 |
| 2010/0242369 | A1 * | 9/2010 | Laird | E05F 15/684 49/358 |
| 2012/0092125 | A1 * | 4/2012 | Farber | G07C 9/00111 340/5.7 |
| 2012/0094604 | A1 * | 4/2012 | Amin | H04B 17/309 455/62 |
| 2012/0249289 | A1 * | 10/2012 | Freese | G08C 17/00 340/5.7 |
| 2012/0297681 | A1 * | 11/2012 | Krupke | F16B 7/0413 49/324 |
| 2013/0321127 | A1 * | 12/2013 | Wilder | G05B 19/042 340/5.71 |
| 2014/0125499 | A1 | 5/2014 | Cate et al. | |
| 2016/0145926 | A1 * | 5/2016 | Jankovsky | E05F 15/40 49/14 |
| 2018/0106104 | A1 * | 4/2018 | Carvalheiro | E06B 9/68 |
| 2018/0119476 | A1 * | 5/2018 | Quaiser | E05F 15/668 |
| 2018/0179800 | A1 * | 6/2018 | Quaiser | E05F 15/668 |

* cited by examiner

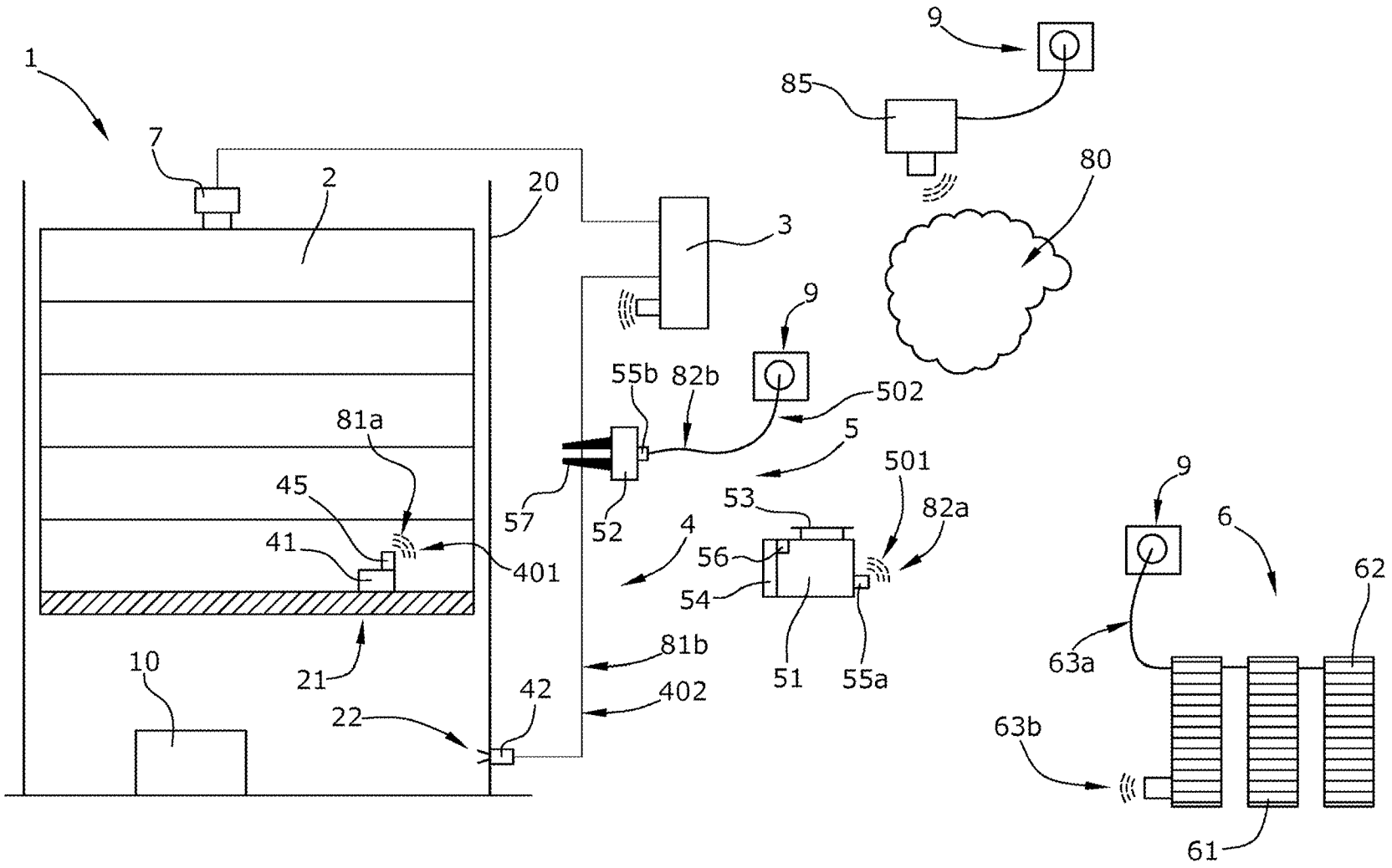
62
6
61
9
63a
63b
80
9
85
82a
501
502
55a
5
51
9
3
53
56
54
82b
4
81b
402
55b
52
57
20
401
42
81a
22
2
45
41
21
7
10
1

SERVICING AND MONITORING SYSTEM FOR MONITORING A DOOR MEMBER

CROSS REFERENCE TO PRIOR APPLICATIONS

This application is a U.S. National Phase application under 35 U.S.C. § 371 of International Application No. PCT/EP2016/059511, filed on Apr. 28, 2016 and which claims benefit to German Patent Application No. 10 2015 111 072.5, filed on Jul. 8, 2015. The International Application was published in German on Jan. 12, 2017 as WO 2017/005388 A1 under PCT Article 21(2).

FIELD

The present invention relates to a servicing and monitoring system for monitoring a door member, such as, for example, a rolling gate or a sectional gate, which is configured to be moved by a drive apparatus, wherein a drive control unit for actuating the drive apparatus and at least one detection device for detecting a gate status are provided, wherein the detection device is connected to the drive control unit to transmit a status signal reporting the gate status via a first data connection.

BACKGROUND

Pure monitoring systems have previously been described. The detection device typically comprises at least one sensor for detecting a gate status, for example, a sensor configured as a light barrier or a closure contact. The detection device respectively transmits the gate status in the form of a status signal to the drive control unit via a first data connection, the drive control unit controlling the drive apparatus in dependence on the status signal received.

The term "gate status" as used herein refers to all statuses or parameters relevant to servicing and/or safety regarding the gate member, in particular a feedback signal on a completely opened or closed gate member, a stop signal in case an obstacle is present in the range of movement of the gate, or a status signal including information on vibration characteristics of the gate member during an opening or closing operation. This information about the gate status primarily serves safety aspects during the operation of the gate. With modern monitoring systems, such information can also be read out in situ in case of servicing. Such reading is only possible, however, with relatively recent and modern monitoring systems and can be performed only during servicing, which is relatively complicated and costly.

Due to the technical conditions, a retrofitting for outputting gate status information is most often not possible or is only possible with substantial technical effort for older monitoring systems which are not equipped by the manufacturer with the above mentioned factory-installed components for reporting gate status information. The reason is that the detection, evaluation and display of gate status information require a plurality of components which in turn require a plurality of possibilities for connection and linking so as to interact with each other. Such connection and linking possibilities are, however, most often not given. The costs for retrofitting also often exceed the potential savings to be expected from using the monitoring system.

SUMMARY

An aspect of the present invention is to provide a monitoring system which can be integrated into a servicing system in a relatively fast, uncomplicated, and economic manner.

In an embodiment, the present invention provides a servicing and monitoring system for monitoring a gate member which is configured to be moved by a drive apparatus. The servicing and monitoring system includes a drive control unit configured to actuate the drive apparatus, at least one detection device configured to detect a gate status of the gate member, a first data connection which connects the drive control unit and the at least one detection device and via which a status signal of the gate member is transmitted from the at least one detection device to the drive control unit, and a data reading device configured to read the status signal sent from the at least one detection device to the drive control unit and to output an alarm signal in dependence on the status signal as read by the data reading device.

BRIEF DESCRIPTION OF THE DRAWING

The present invention is described in greater detail below on the basis of embodiments and of the drawing in which:

FIG. 1 schematically shows a monitoring system with two separately formed data reading devices.

DETAILED DESCRIPTION

The present invention provides a data reading device which is adapted to read the status signal transmitted by the detection unit to the drive control device, and to output an alarm signal in dependence on the status signal read out. The data reading device may in particular comprise a data reading module for reading or intercepting the status signal, as well as a reporting module for outputting an alarm signal generated in dependence on the read status signal. The data reading signal may be a module for receiving data which is of a relatively simple structure. The reporting module may be a signaling unit with an LED, wherein the LED may indicate the gate status, for example, in the colors green, orange or red. The alarm signal may alternatively be a data signal carrying information, for example, information about a gate stop due to an interruption of a light barrier, or a gate stop caused by increased vibration, or a gate stop caused by a triggering of the closing edge safety device. It is also possible that the status signal and the report signal are identical, which is in particular the case when the pure status signal is passed on. With existing older monitoring systems, a relatively simple retrofitting for reporting gate status information is thus made possible. The date reading device can in particular capture information from a completely separate, a closed, or an autonomously operating monitoring system and process the information for further use, in particular check, evaluate, display and/or pass on the information outside the system for servicing purposes.

The data reading device can, for example, be connected to the first data connection either mechanically or via radio. The term "mechanically" in the present context refers to a physical or a material connection between the data reading device and the first data connection, for example, via a wire or a terminal. This is particularly advantageous in those cases where the first data connection is designed as a cable connection or a wired connection. If the first data connection is designed as a radio connection, the data reading device may also be connected with the first data connection via radio, for example, by a logical link. The data reading device can thereby be integrated, also subsequently, into a monitoring system in a relatively simple manner.

It is advantageous in the case of a wired first data connection if the data reading device has an insulation-displacement connector for a mechanical connection to the first data connection. The data reading device can thereby be mechanically coupled or clamped to the line or to the first data connection in a relatively simple and uncomplicated manner.

For the case that the first data connection is a radio connection, it is advantageous if the data reading device comprises a network-compatible, Internet-compatible and/or mobile radio-compatible communication module. The communication module may basically also serve to pass on the alarm signal. The data reading device may be connected to the first data connection via the communication module, for example, via a local network. The data reading device may also be connected to a global network, in particular the Internet, and/or a telecommunications network, in particular a mobile communications network. The data reading device or the communication module may comprise a data transmission interface therefor, such as a network connector, to pass the alarm signal on via a second data connection. The communication module may also comprise a modem for building or establishing a second data connection via a telecommunications network.

The date reading device may generally be supplied with energy in a completely autonomous manner independent of the monitoring system so that the data reading device can be placed at almost any suitable location, for example, in the vicinity of a live wall socket. The data reading device can therefore, for example, be configured as a separate component. The data reading device may thus be configured to be independent from the actual detection device and the drive control unit, whereby the data reading device can be retrofitted in a relatively simple manner.

In particular in the above mentioned embodiment, the data reading device may comprise a power supply of its own, for example, using a solar cell, and/or an energy storage, for example, a battery, so that the data reading device can be supplied with energy independent of the monitoring system. This embodiment is of course not restricted to the above embodiment.

In an embodiment, the data reading device can, for example, be connected or arranged immediately at the detection device, in particular at a data output point of the detection device. The monitoring system may thus be arranged relatively centrally and uniformly and the data reading device can be supplied with power via the detection device. The data reading device may be connected to a power supply line of the detection device therefor.

It is also possible to configure the data reading device as a part of the detection device, for example, integrated in a sensor. It is thereby possible, for example, during an exchange of a sensor, such as a light barrier sensor, as provided by a servicing interval, to subsequently integrate a data reading device into a monitoring system in a particularly simple manner.

The data reading device may comprise a memory module for an intermediate storage of the status signals intercepted from the first data connection. The alarm signal therefore does not need to be transmitted continuously, transmission can much rather be restricted to relatively few points in time. The alarm signal can, for example, be outputted only when a memory module of the data reading device is full or at a predetermined time interval. Power to be supplied to the data reading device can thereby be saved.

The data reading device can, for example, be connected to a central unit via a second data connection for transmitting the alarm signal. The central unit may be located centrally at a security service, a servicing company, and/or a manufacturer.

The alarm signals received can, for example, be stored and/or evaluated in the central unit. The central unit may comprise a database memory therefor. It is thereby possible to in particular optimize the servicing intervals and the servicing as such.

For an evaluation of the alarm signals, the central unit can, for example, comprise an evaluation device. The alarm signals can thereby be evaluated in the central unit, in particular for maintenance and servicing purposes. Such an evaluation can, for example, yield information about the need for servicing, the urgency for servicing, or an optimized servicing interval.

The first data connection and/or the second data connection may each be designed to be at least partly wired and/or use radio. An interception of the status signals and a transmission of the alarm signals can thereby be performed in a particularly simple manner.

The detection device can, for example, comprise at least one sensor from which the status signal is sent to the drive control unit. The monitoring system can therefore be of a relatively compact structure.

The detection device can, for example, comprise at least one sensor which has a radio module. The radio module may in particular be suitable for linking to a WLAN network or for a Bluetooth connection. The sensor may thereby be connected to an existing network or may establish the first data connection in a relatively simple and economic manner via radio.

The detection device advantageously comprises at least one sensor which is a rotary encoder, a light barrier, a closing edge safety device, or a vibration sensor. Conclusions can thereby be draw regarding different technical features of the gate member while reading the status signal. The monitoring system may also provide a relatively safe operation of the gate.

The present invention will be explained in greater detail below under reference to an embodiment and to FIG. 1.

FIG. 1 shows an application of the servicing and maintenance system 1 of the present invention for monitoring a gate member 2 adapted to be moved by a drive apparatus 7. Various electronic components are provided in a manner known per se to provide a functioning of the gate member 2 (shown as a rolling gate in FIG. 1) that is safe and exact under control aspects, such as a drive control unit 3 for controlling the drive apparatus 7, a detection device 4 with different sensors 41, 42 for the detection of conditions relevant to safety and/or servicing, as well as various data connections 81*a*, 81*b*, 82*a*, 82*b* for the transmission of signals. In the shown embodiment, a local radio network 80, in particular a so-called WLAN (wireless local area network), is provided for interlinking the individual components. The local radio network 80 may also be connected to the worldwide Internet 9.

For a safe operation of the gate member 2 guided in a guide rail 20 and movable in a vertical direction, the servicing and monitoring system 1 comprises the detection device 4 for the detection of, in particular, a gate status 21, 22 such as, for example, an increase in the vibrations of the gate during movement or a possible obstacle 10 in the movement range of the gate member 2. In the shown embodiment, the detection device 4 comprises a first sensor 41 and a second sensor 42, wherein the sensors 41, 42 each send a status signal 401, 402 to the drive control unit 3, and the status signal 401, 402 respectively includes information about the gate status 21, 22. The drive control unit 3 can then control the drive apparatus 7 as a function of the received status signals 401, 402.

The first sensor 41 is configured as a closing edge safety device and serves to monitor a movement range of the gate member 2 during a closing operation. Since the first sensor 41 is arranged at the mobile gate member 2 and the drive control unit 3 is stationary, it is advantageous that a first data connection 81*a* is formed between the first sensor 41 and the drive control unit 3 as a wireless radio link. The first sensor 41 can thereby send the first status signal 401 to the drive control unit 3 via radio. The first sensor 41 comprises a radio module 45 therefor (which is not illustrated in detail). In the shown embodiment, the radio link 81*a* is established via the local radio network 80 to which at least both the first sensor 41 and the drive control unit 3 are connected. A direct radio link 81*a*, for example, a Bluetooth connection, can alternatively or additionally be established between the first sensor 41 and the drive control unit 3.

The second sensor 42 which operates completely independent of the first sensor 41 is stationarily arranged at the guide rail 20 and also serves to monitor a movement range of the gate member 2. The second sensor 42 is connected to the drive control unit 3 via a wired first data connection 81*b* and sends a second status signal 402 including information about a second gate status 22, for example, whether the light barrier is interrupted or not, to the drive control unit 3. In the shown embodiment, an obstacle 10 is in the movement range of the gate member 2 so that the light barrier is interrupted and the second status signal 402 includes information thereof.

It should be clear that the detection device 4 is not restricted to the number of sensors illustrated herein by way of example. The sensors as such may also be entirely different sensors for the detection of a gate status, wherein the term "gate status" should be understood as referring to all statuses and status variables of the gate member 2 relevant to servicing and/or safety.

Two data reading devices 5 are provided in the shown embodiment to improve the servicing and the monitoring of the gate member 2, namely, a first data reading device 51 and a second data reading device 52. The data reading devices 51, 52 are each suited to read the status signal 401, 402 sent from the detection device 4 to the drive control unit 3 out from the data connection 81*a*, 81*b* and to output an alarm signal 501, 502 in dependence on the read status signal 401, 402. The status signal 401, 402 and/or the alarm signal 501, 502 may respectively include information about the gate status 21, 22, for example, how often a gate has been opened and closed, the frequency of emergency stops, what kind of vibrations the gate is subjected to during a movement, etc. The status signal 401, 402 and the alarm signal 501, 502 may also generally be identical. The alarm signal 501, 502 is advantageously transmitted to a central unit 6 via the Internet 9. The central unit 6 can, for example, be a manufacturer or a servicing company which may be domiciled anywhere in the world and merely needs access to the Internet 9. In the shown embodiment, the central unit 6 comprises a database memory 61 for storing the alarm signals 501, 502 as well as an evaluation device 62 for evaluating the alarm signals 501, 502.

The first data reading device 51 is designed as a separate component and may operate entirely autonomously so that it is possible to place the first data reading device 51 at any optional position in the area of the gate member 2. The first data reading device 51 has a solar cell 53 (which is not illustrated in detail) as well as a battery 54 to provide power. Besides a read-out module (which is not illustrated in detail), the first data reading device 51 comprises a first network- and Internet-compatible communication module 55*a*. Via the first communication module 55*a*, the first data reading device 51 is connected, for example, permanently, with the local radio network 80 via radio. Via the read-out module (which is not illustrated in detail) and the first communication module 55*a*, it is possible for the first data reading device 51 to read or intercept the radio data connection established between the first sensor 41 and the drive control unit 3. It is thereby provided that the first status signal 401 is merely called by the first data reading device 51 without interfering with the first status signal 401 or the transmission thereof to the drive control unit 3, in particular without intercepting, modifying, or generating a new signal in the first data connection 81*a*. The first status signal 401 read by the first data reading device 51 can now be buffered in a memory module 56 of the first data reading device 51 (the memory module 56 is not illustrated in detail). Depending on the setting, the alarm signal 501 is sent immediately or at a later time from the first data reading device 51 to the central unit 6 via the local radio network 80, in which a second data connection 82*a* is established, and via the Internet 9. The first communication module 55*a* may alternatively or additionally also be mobile communication-compatible so that the first status signal 401 read by the first data reading device 51 is sent to the central unit 6 via mobile communications.

The second date reading device 52 comprises a read-out module (which is not illustrated in detail) having an insulation-displacement connector 57 for mechanical clamping to the wired first data connection 81*b*. The second data reading device 52 can thereby be mounted and connected to the wired first data connection 81*b* in a relatively simple manner. The second data reading device 52 further comprises a second communication module 55*b* which, in a manner known per se, is connected to the Internet 9 in the form of a network adapter having a network connector and a network cable. The second status signal 402 read from the wired first data connection 81*b* by the second data reading device 52 can thereby be sent from the second data reading device 52 to the central unit 6 as an alarm signal 501 via a second data connection 82*b*, in particular via the Internet 9. The second data reading device 52 can be supplied with power via this wired network connection in a manner known per se. It may be advantageous in this regard to connect the second data reading device 52 immediately in the vicinity or directly to the detection device 4 or to the drive control unit 3. The second communication module 55*b* may alternatively or additionally also be mobile communication-compatible so that the second status signal 402 read by the second data reading device 52 is sent to the central unit 6 via mobile communications.

It should be clear that the data reading devices 5, 51, 52 are not restricted to the exemplary number or configuration illustrated. The data reading device 51, 52, depending on the individual conditions of an existing gate system, may rather comprise different combinations of respective suitable read-out modules and communication modules 55*a*, 55*b*.

In the central unit 6, the collected alarm signals 501, 502 can now be evaluated with regard to the number of times a gate has been opened and closed, the number of emergency stops, what kind of vibrations the gate is subjected to during movement, etc. It is possible as a result of this evaluation, for example, to set or adjust an individual servicing interval for each gate member in operation. Such a servicing and monitoring system 1 is installed and ready for use in a relatively uncomplicated and quick manner using the data reading devices 51, 52.

The present invention is not limited to embodiments described herein; reference should be had to the appended claims.

LIST OF REFERENCE NUMERALS

1 servicing and monitoring system
2 gate member/rolling gate
20 guide rail
21 gate status
22 gate status
3 drive control unit
4 detection device
41 first sensor
42 second sensor
45 radio module
401 status signal
402 status signal
5 data reading device
51 first data reading device
52 second data reading device
53 solar cell
54 battery
55*a* first communication module
55*b* second communication module
56 memory module
57 insulation-displacement connector
501 alarm signal
502 alarm signal
6 central unit
61 database memory
62 evaluation device
63*a* Internet connection
63*b* mobile communications connection
7 drive apparatus
80 local radio network
81*a* first data connection/radio link
81*b* second data connection
82*a* second data connection
82*b* second data connection
85 router
9 Internet, Internet connection
10 obstacle

What is claimed is:

1. A servicing and monitoring system for monitoring a gate member which is configured to be moved by a drive apparatus, the servicing and monitoring system comprising:

a drive control unit actuates the drive apparatus;

at least one detection device detects a gate status of the gate member;

a first data connection which connects the drive control unit and the at least one detection device and via which a status signal of the gate member is transmitted from the at least one detection device to the drive control unit;

a data reading device to read the status signal sent from the at least one detection device to the drive control unit and to output an alarm signal in dependence on the status signal as read by the data reading device; and a central unit comprising a data base memory which stores the alarm signal and an evaluation unit which evaluates the alarm signal, wherein, the data reading device is connected to the central unit via a second data connection.

2. The servicing and monitoring system as recited in claim 1, wherein the gate member is a rolling gate or a sectional gate.

3. The servicing and monitoring system as recited in claim 1, wherein the data reading device comprises a mechanical connection or a radio connection with the first data connection.

4. The servicing and monitoring device system as recited in claim 1, wherein the data reading device comprises an insulation-displacement connector.

5. The servicing and monitoring device system as recited in claim 1, wherein the data reading device comprises at least one of a network-compatible communication module, an Internet-compatible communication module, and a mobile radio-compatible communication module.

6. The servicing and monitoring device system as recited in claim 1, wherein the data reading device is designed as a separate component.

7. The servicing and monitoring device system as recited in claim 1, wherein the data reading device comprises at least one of a solar cell and a battery.

8. The servicing and monitoring device system as recited in claim 1, wherein the data reading device is connected to the drive control device or to the at least one detection device.

9. The servicing and monitoring device system as recited in claim 1, wherein the data reading device is designed to comprise a part of the drive control device or of the detection device.

10. The servicing and monitoring device system as recited in claim 1, wherein the data reading device comprises a memory module.

11. The servicing and monitoring device system as recited in claim 1, wherein at least one of the first data connection and the second data connection are configured at least in part as at least one of a wired connection and a radio connection.

12. The servicing and monitoring device system as recited in claim 1, wherein the at least one detection device comprises at least one sensor from which the status signal is transmitted to the drive control unit.

13. The servicing and monitoring device system as recited in claim 12, wherein at least one the detection device comprises at least one sensor which comprises a radio module.

14. The servicing and monitoring device system as recited in claim 1, wherein at least one the detection device comprises at least one sensor which is provided as a rotary encoder, a light barrier, a closing edge safety device or a vibration sensor.

* * * * *